US010580385B2

(12) United States Patent
Kuo

(10) Patent No.: US 10,580,385 B2
(45) Date of Patent: Mar. 3, 2020

(54) METHOD FOR ENHANCING LUMINANCE UNIFORMITY OF A DISPLAY PANEL

(71) Applicant: Hung-Cheng Kuo, Hsinchu (TW)

(72) Inventor: Hung-Cheng Kuo, Hsinchu (TW)

( * ) Notice: Subject to any disclaimer, the term of this patent is extended or adjusted under 35 U.S.C. 154(b) by 29 days.

(21) Appl. No.: 16/004,895

(22) Filed: Jun. 11, 2018

(65) Prior Publication Data

US 2019/0378473 A1 Dec. 12, 2019

(51) Int. Cl.
*G09G 5/10* (2006.01)
*G09G 3/3208* (2016.01)

(52) U.S. Cl.
CPC ..... *G09G 5/10* (2013.01); *G09G 3/3208* (2013.01); *G09G 2320/0233* (2013.01); *G09G 2360/16* (2013.01)

(58) Field of Classification Search
None
See application file for complete search history.

(56) References Cited

U.S. PATENT DOCUMENTS

2010/0013751 A1* 1/2010 Kerofsky ..... G09G 3/006 345/89
2016/0267838 A1 9/2016 Zhang et al.
2018/0102088 A1* 4/2018 Deng ..... G09G 3/2074
2018/0191371 A1* 7/2018 Tao ..... G09G 3/36
2018/0366056 A1* 12/2018 Tang ..... G09G 3/3208

OTHER PUBLICATIONS

The Search Report issued to European counterpart application No. 19178019.6 by the EPO dated Oct. 15, 2019 (13 pages).

* cited by examiner

*Primary Examiner* — Joseph R Haley
(74) *Attorney, Agent, or Firm* — Michael Best & Friedrich LLP

(57) ABSTRACT

A method for enhancing luminance uniformity of a display panel that includes multiple sub-pixels for a same color element is proposed to include: measuring, for each of the sub-pixels, luminance at multiple predetermined luminance codes, so as to obtain a plurality of data points; performing a two-stage curve fitting to obtain a fitting function that describes a curve fitting the data points; and performing demura operation on an image to be displayed by the display panel based on the fitting function.

9 Claims, 6 Drawing Sheets

Gray code

METHOD FOR ENHANCING LUMINANCE UNIFORMITY OF A DISPLAY PANEL

FIELD

The disclosure relates to a data processing method, and more particularly to a data processing method for enhancing luminance uniformity of a display.

BACKGROUND

In the display panel industry, mura, referring to non-uniformity of a display panel in terms of luminance, is always a problem to be solved. Mura may result from inability to perform consistent and satisfactory manufacturing process control, such as control of a vapor deposition process for OLED panels, a mass transfer process for micro LED panels, etc. Therefore, multiple demura (i.e., mura correction or elimination) technologies have been developed to alleviate the mura effect for the display panel. In one conventional demura technology, polynomial approximation is used to, for each sub-pixel of the display panel, obtain a fitting curve that fits a relationship between grayscale code (also called gray level) and luminance of the sub-pixel, and a voltage or current output to the sub-pixel is adjusted based on a difference between the fitting curve and a desired curve that represents a desired relationship between grayscale code and luminance for all sub-pixels corresponding to the same color element, so as to minimize deviation of the actual output luminance of the sub-pixel from the desired luminance for the same sub-pixel. However, traditional polynomial approximation usually fails to fit the relationship between grayscale code and luminance of the sub-pixel well, leading to poor demura outcome.

Furthermore, in one conventional implementation, the demura operation is performed by the source driver ICs with its memory and logic circuits. Because of their limited memory capacity and poor computation ability, the source driver ICs can only implement simple demura algorithm so the demura result is usually not satisfactory.

SUMMARY

Therefore, an object of the disclosure is to provide a method for enhancing luminance uniformity of a display panel that can alleviate at least one of the drawbacks of the prior art.

According to the disclosure, the method for enhancing luminance uniformity of a display panel that includes a plurality of sub-pixels for a same color element is proposed to include:

measuring, by an automated optical inspection (AOI) system and for each of the sub-pixels, luminance of the sub-pixel each time a different one of multiple predetermined AOI luminance codes is used to drive the sub-pixel, so as to obtain a plurality of data points for the sub-pixel, where each of the data points is composed of one of the predetermined AOI luminance codes and a luminance value of the sub-pixel that is measured by the AOI system when said one of the predetermined AOI luminance codes is used to drive the sub-pixel;

generating, by the computer device, a first polynomial function describing a first reference curve that represents a first reference relationship between luminance codes and luminance and that has a plurality of first reference data points each of which is composed of one of the predetermined AOI luminance codes and a first reference luminance value corresponding to said one of the predetermined AOI luminance codes;

generating, by the computer device and for each of the sub-pixels, a plurality of second reference data points each of which is composed of one of the predetermined AOI luminance codes, and a second reference luminance value relating to a difference between the first reference luminance value corresponding to said one of the predetermined AOI luminance codes and the luminance value of one of the data points corresponding to the sub-pixel and said one of the predetermined AOI luminance codes;

performing, by the computer device and for each of the sub-pixels, curve fitting on the second reference data points corresponding to the sub-pixel to obtain a second polynomial function that describes a curve fitting the second reference data points which correspond to the sub-pixel;

acquiring, by the computer device and for each of the sub-pixels, a data-points fitting function based on the first polynomial function and the second polynomial function;

performing, by a computerized device that includes the display panel, demura operation on pre-demura image frame data based on the data-points fitting functions corresponding to the sub-pixels to generate post-demura image frame data, wherein the pre-demura image frame data relates to an image of a frame to be displayed by the display panel; and displaying, by the display panel, the image of the frame based on the post-demura image frame data.

BRIEF DESCRIPTION OF THE DRAWINGS

Other features and advantages of the disclosure will become apparent in the following detailed description of the embodiment(s) with reference to the accompanying drawings, of which.

DETAILED DESCRIPTION

Figure 1:
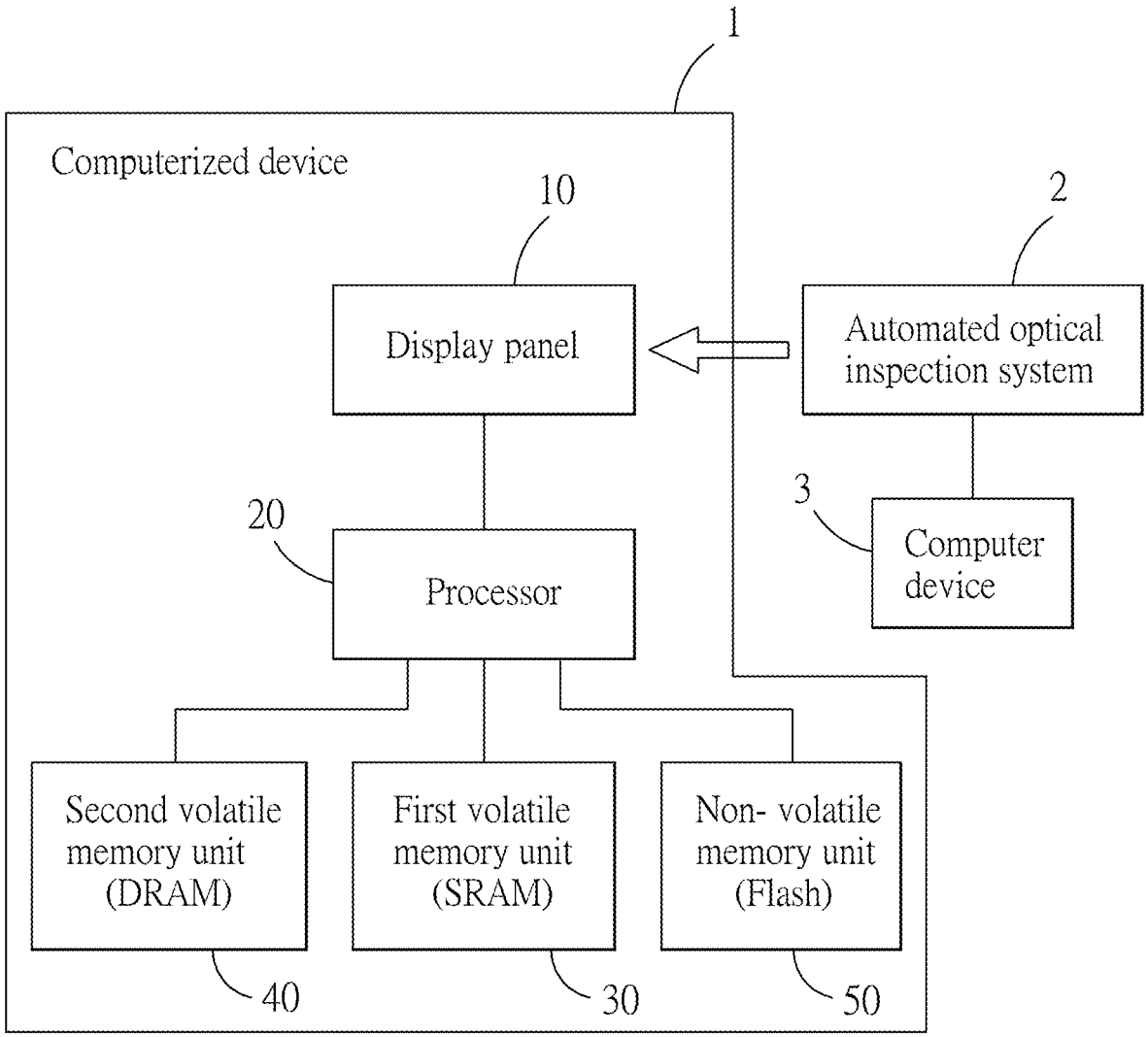
FIG. 1 is a block diagram illustrating a system to implement an embodiment of a method for enhancing luminance uniformity of a display panel according to the disclosure.

Before the disclosure is described in greater detail, it should be noted that where considered appropriate, reference numerals or terminal portions of reference numerals have been repeated among the figures to indicate corresponding or analogous elements, which may optionally have similar characteristics.

Referring to FIG. 1, the embodiment of the method for enhancing luminance uniformity of a display panel 10 according to this disclosure is implemented by a computerized device 1, an automated optical inspection (AOI) system 2, and a computer device 3 for demura computation.

In this embodiment, the computerized device 1 may be, for example, a smartphone, a notebook, a television, etc., which includes the display panel 10, a processor 20, a first volatile memory unit 30, a second volatile memory unit 40, and a non-volatile memory unit 50 that are integrated together as a single product. However, this disclosure is not limited in this respect, and these components may each be an independent product in other embodiments.

In this embodiment, the display panel 10 may be, for instance, an OLED (organic light emitting diode) panel, a micro LED (light emitting diode) panel, etc., and is electrically connected to the processor 20; the processor 20 may be, as an example, an application processor that is mounted on a main board of the computerized device 1 in a case that the computerized device 1 is a smartphone; the first volatile memory unit 30 is electrically connected to the processor 20, and may be, for instance, an SRAM (static random access memory) unit including at least one SRAM; the second volatile memory unit 40 is electrically connected to the processor 20, has an access speed lower than that of the first volatile memory unit 30, and may be, for instance, a DRAM (dynamic random access memory) unit that includes at least one DRAM and that has a lower access speed (i.e., longer access time) relative to the SRAM unit; and the non-volatile memory unit 50 may be, for instance, a flash memory unit including at least one flash memory, a solid-state storage device, a hard disk drive, etc., and is electrically connected to the processor 20. It is noted that this disclosure is not limited to the abovementioned exemplary configurations.

The display panel 10 includes a plurality of pixels (e.g., 1920×1080 number of pixels for an FHD (full high definition) panel), each of which may consist of multiple sub-pixels each corresponding to a color element (e.g., a red color element, a green color element, a blue color element, etc.).

Figure 2:
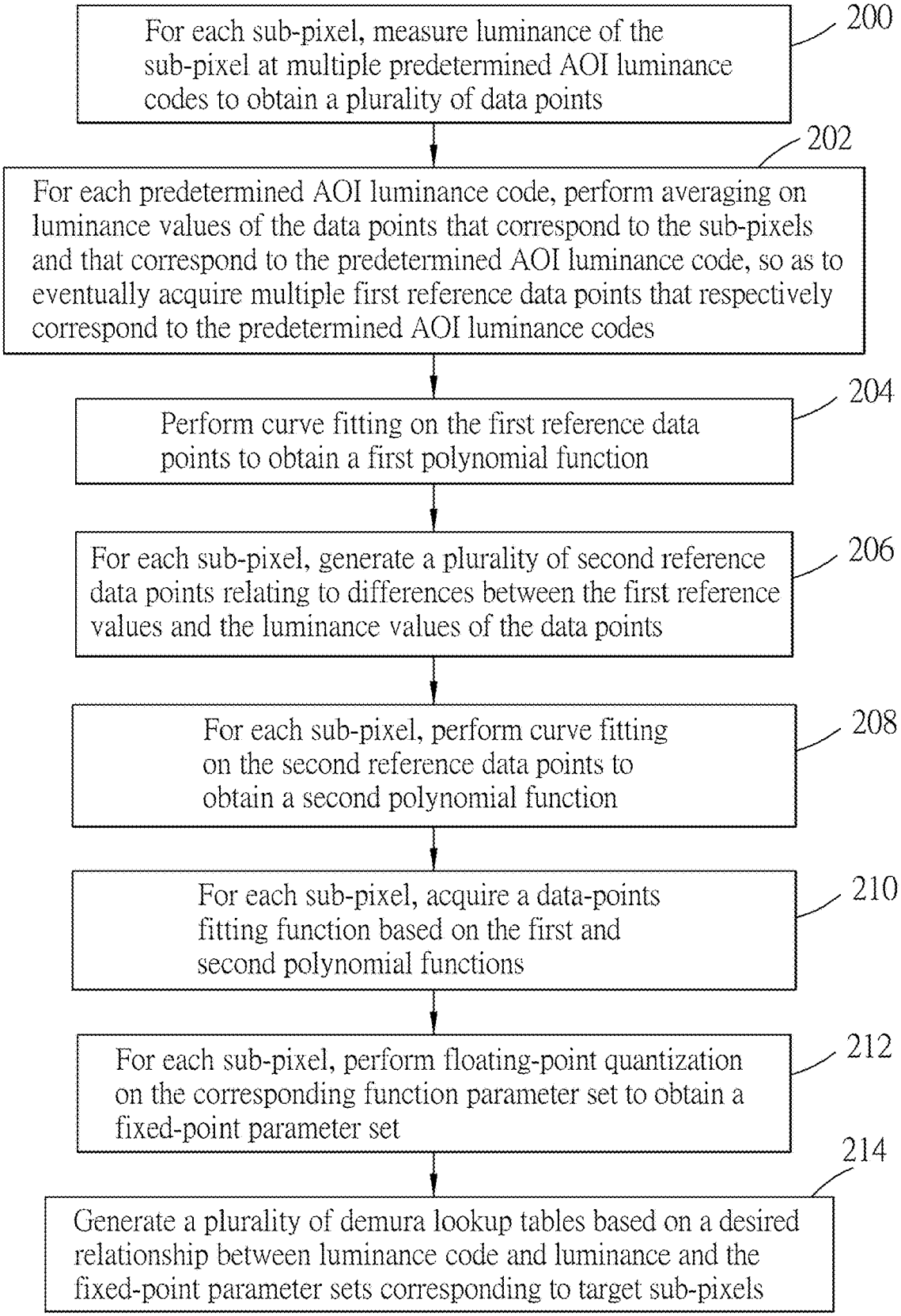
FIG. 2 is a flow chart illustrating a method of acquiring a fitting function for each of sub-pixels of a display panel.

Referring to FIG. 2, in this embodiment, the AOI system 2 is used to measure (step 200), for each of the sub-pixels of the display panel 10 that correspond to a specific color element, luminance of the sub-pixel each time a different one of multiple predetermined AOI luminance codes is inputted to drive the sub-pixel for the sub-pixels, so as to obtain a plurality of data points for each sub-pixel, where each data point is composed of one of the predetermined AOI luminance codes and a luminance value of the sub-pixel that is measured when said one of the predetermined AOI luminance codes is used to drive the sub-pixel. The automated optical inspection may be performed with the display panel 10 alone, or with the display panel assembled in the computerized device 1, so step 200 may be implemented in either a production line of the display panel 10 or a production line of the computerized device 1. It is noted that, for each of the sub-pixels, different luminance codes theoretically correspond to different values of luminance, respectively, and the luminance codes may be represented in a form of grayscale codes, control codes or voltages. A number of grayscale codes relates to a number of bits used to represent the data of each sub-pixel. For example, an 8-bit sub-pixel may correspond to 28=256 shades of gray in grayscale. The control codes are used to represent voltages to be provided to the sub-pixel. For example, a voltage that can be provided by a source driver IC may range from 3V to 6V with the range being divided into 1024/2=512 voltage levels (in practice, there may be 1024 levels used for 0V to 6V, but the voltage actually used by the source driver IC may range only from 3V to 6V, corresponding to 512 voltage levels) each corresponding to a respective control code. In this example, the 256 shades of gray respectively correspond to 256 out of 512 control codes, and also 256 different voltages. In the embodiment of this disclosure, the luminance codes are exemplified using grayscale codes, but this disclosure is not limited in this respect.

Figure 3:
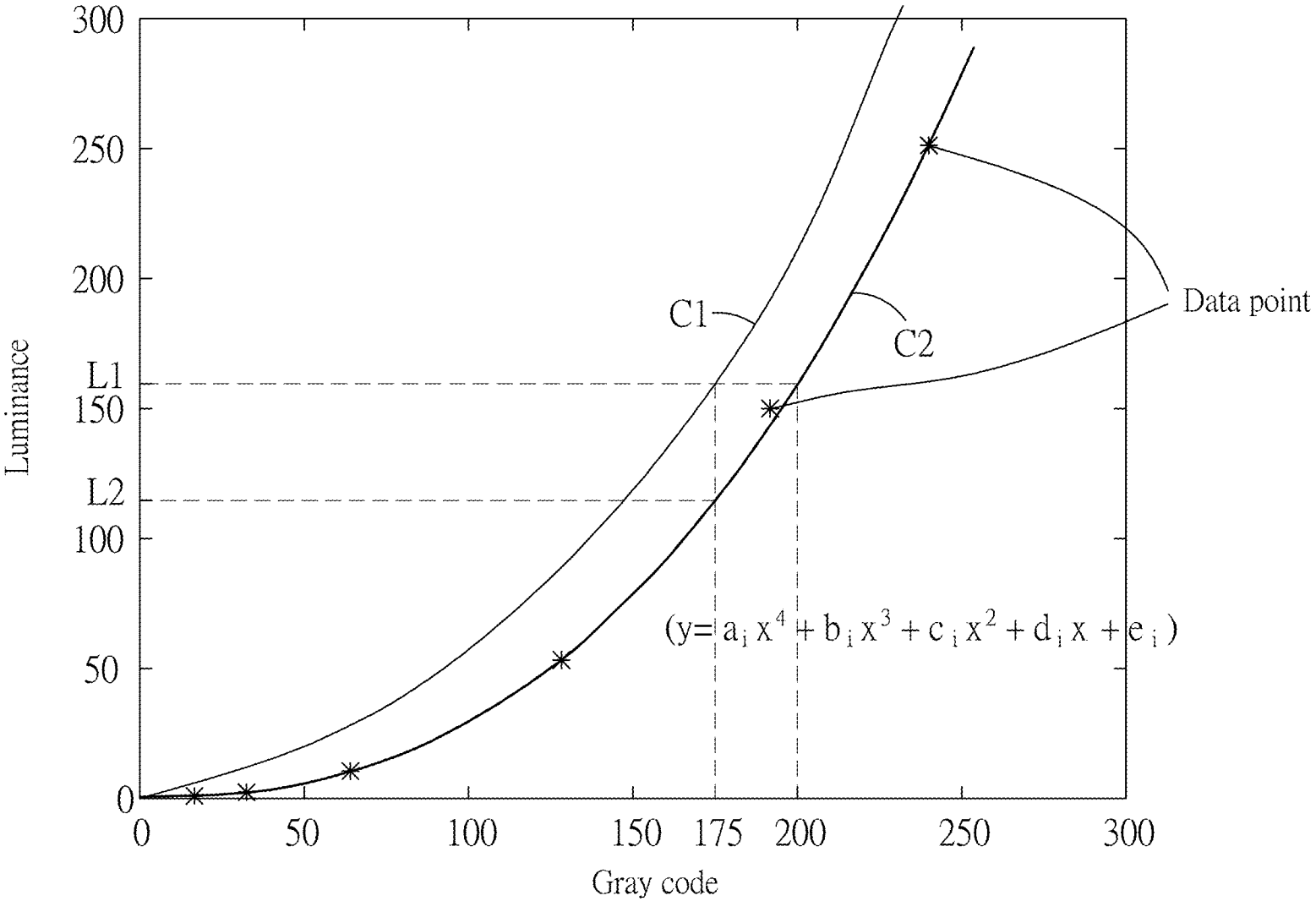
FIG. 3 is a plot showing a curve representing a desired relationship between luminance codes and luminance, and a fitting curve that fits data points measured for a particular sub-pixel.

FIG. 3 is a plot that exemplarily shows a curve (C1) representing a desired relationship between luminance codes and luminance for all sub-pixels that correspond to the same color element, and several asterisks respectively represent the data points for a particular sub-pixel obtained by the AOI system 2. Apparently, the data points do not coincide with the curve (C1), and the demura technology comes into play. In practice, it is inefficient to measure the luminance of the sub-pixel for all possible luminance codes, so polynomial approximation can be used to acquire a target fitting curve (C2) that fits the limited number of data points and it is assumed that the target fitting curve (C2) well approaches an intrinsic (or actual) relationship between luminance codes and luminance for the sub-pixel.

Referring to FIG. 2 again, in this embodiment, a two-stage curve fitting algorithm (see steps 202-204 for a first stage, and steps 206-208 for a second stage) is proposed to generate, for each of the sub-pixels, a data-points fitting function which describes a data-points fitting curve that fits the data points corresponding to the sub-pixel well and that serves as a basis for obtaining the target fitting curve for the sub-pixel.

In the first stage, the computer device 3 generates a first polynomial function describing a first reference curve that represents a first reference relationship between luminance codes and luminance and that has a plurality of first reference data points each of which is composed of one of the predetermined AOI luminance codes and a first reference luminance value corresponding to said one of the predetermined AOI luminance codes. In one embodiment, for each of the first reference data points, the first reference luminance value relates to the luminance values of the multiple data points that correspond to the predetermined AOI luminance codes of the first reference data point.

Figure 4:
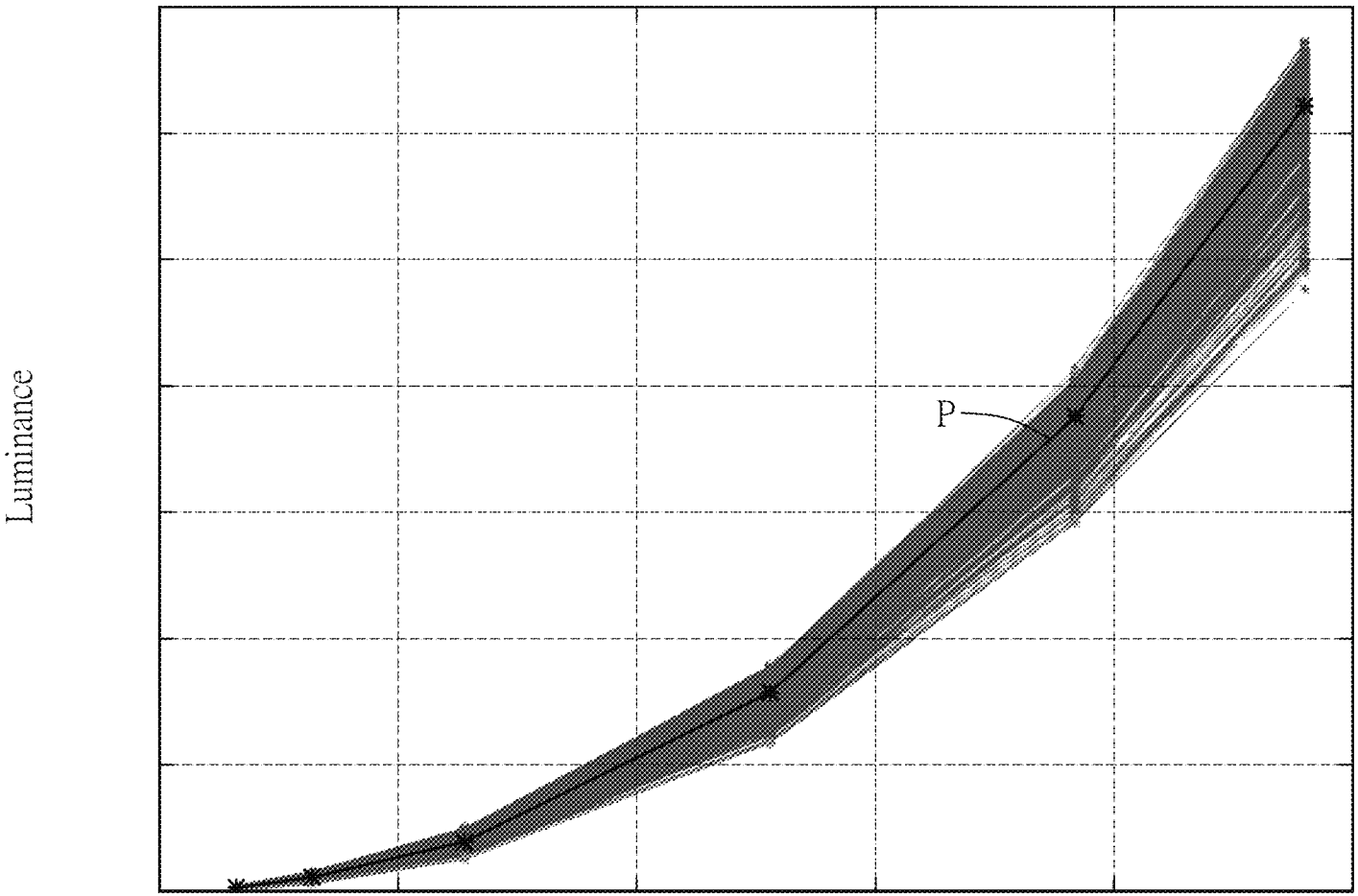
FIG. 4 is a plot illustrating that data points measured for multiple sub-pixels are used to acquire several first reference points for demura operation.

In this embodiment, the computer device 3 performs in step 202, for each of the predetermined luminance codes, averaging on the luminance values of multiple data points that respectively correspond to the sub-pixels and that all correspond to the predetermined AOI luminance codes (i.e., the luminance values of multiple sub-pixels measured when the predetermined AOI luminance codes is used to drive the sub-pixels), so as to eventually acquire the first reference data points that respectively correspond to the predetermined AOI luminance codes. In other words, for each of the first reference data points, the first reference luminance value is an average of the luminance values of the data points corresponding to the predetermined AOI luminance codes of the first reference data point. In one embodiment, the averaging is performed based on all of the sub-pixels of the display panel 10. FIG. 4 shows a plurality of gray polylines each of which is formed by connecting the data points that correspond to a respective one of the sub-pixels of the display panel 10, and a black polyline (P) which is formed by connecting the first reference data points. For instance, the y-value of the first reference data point p128 is an average of the luminance values of all of the sub-pixels of the display panel 10 measured at the luminance codes of 128 in step 200.

In step 204, the computer device 3 performs curve fitting on the first reference data points to obtain a first polynomial function g(x) that describes a first fitting curve fitting the first reference data points and that has a degree of N. In order to have a low system load for demura operation, N is 3 or 4 in this embodiment, but this disclosure is not limited in this respect. In other embodiments, N may be a positive integer greater than 4, or smaller than 3, depending on the requirement of the designer.

Steps 206-210 are performed with respect to each of the sub-pixels, so as to acquire a plurality of data-points fitting functions respectively for the sub-pixels.

In step 206, the computer device 3 generates, for each of the sub-pixels, a plurality of second reference data points each of which is composed of one of the predetermined AOI luminance codes, and a second reference luminance value relating to a difference between the first reference value corresponding to said one of the predetermined AOI luminance codes and the luminance value of one of the data points corresponding to the sub-pixel and said one of the predetermined AOI luminance codes. In this embodiment, the second reference luminance value of each of the second reference data points for each of the sub-pixels is obtained by subtracting the first reference luminance value that corresponds to the predetermined AOI luminance codes of the second reference data point from the luminance value of one of the data points that corresponds to the sub-pixel and the predetermined AOI luminance codes of the second reference data point.

In step 208, the computer device 3 performs, for each of the sub-pixels, curve fitting on the corresponding second reference data points to obtain a corresponding second polynomial function h(x) that describes a second fitting curve fitting the corresponding second reference data points and that has a degree of M, where M≤N. Particularly, in order to obtain good curve fitting and lower complexity in computation, M=N−1 when N>1, and M=N when N=1, but this disclosure is not limited in this respect.

In step 210, the computer device 3 acquires, for each of the sub-pixels, the respective data-points fitting function p(x) which describes the data-points fitting curve based on the first polynomial function g(x) and the corresponding second polynomial function h(x), and extracts, for each of the sub-pixels, a function parameter set composed of a plurality of function parameters from the data-points fitting function p(x) that corresponds to the sub-pixel. In this embodiment, the data-points fitting function p(x) is acquired according to:

$$p(x)=g(x)+h(x)$$

Assuming that the data-points fitting function p(x) for an ith one of the sub-pixels is a four-degree polynomial function of: p(x)=afix4+bfix3+cfix2+dfix+efi, the function parameter set for p(x) is composed of the function parameters afi, bfi, cfi, dfi and efi. At this time, the function parameters are in a form of floating points, which may result in difficulty in terms of data storage and circuit complexity. Accordingly, in step 212, the computer device 3 performs, for each of the sub-pixels, floating-point quantization on the function parameter set that corresponds to the sub-pixel, in order to obtain a fixed-point parameter set that is used to describe the target fitting curve for the sub-pixel (exemplified as a set of parameters ai, bi, ci, di and ei to describe the target fitting curve (C2) in FIG. 3) conforming to a single-pixel criterion and a pixel-difference criterion. In this embodiment, the single-pixel criterion relates, for each of the sub-pixels, to a fitting deviation that corresponds to the sub-pixel and that relates to a mismatch between the target fitting curve and the data points corresponding to the sub-pixel; and the pixel-difference criterion relates, for each of the sub-pixels, to differences between the fitting deviation corresponding to the sub-pixel and the fitting deviations corresponding to some of the sub-pixels that are adjacent to the sub-pixel. After the floating-point quantization, different but similar function parameter sets for different sub-pixels may be converted into the same fixed-point parameter set, so that a total number of fixed-point parameter sets may be significantly less than a total number of function parameter sets.

In this embodiment, the floating-point quantization in step 212 is a trial-and-error process, which may include multiple cycles to ultimately obtain the fixed-point parameter set, where each cycle includes a quantization step, and a determination step following the quantization step. Relevant description that follows will be made with respect to a single sub-pixel.

In the quantization step, the computer device 3 performs floating-point quantization on the function parameter set based on a fixed-point resolution and a quantization algorithm combination to acquire a trial parameter set which is used to describe a trial fitting curve for the sub-pixel and which is in a form of fixed points. The fixed-point resolution refers to a number of bits used to represent a parameter. Higher fixed-point resolution means that the parameter is represented by a larger number of bits. However, different parameters may be represented using different numbers of bits. In this embodiment, the quantization algorithm combination is a combination of quantization algorithms which respectively correspond to the function parameters, and each of which is one of a rounding function (e.g., a function to round a number to a nearest integer), a ceiling function (e.g., a function to output the least integer greater than or equal to an input number) and a floor function (e.g., a function to output the greatest integer smaller than or equal to an input number). In other words, the quantization algorithms used for different function parameters may be different. Techniques for floating-point quantization should be well known to persons skilled in the art, so details thereof are omitted herein for the sake of brevity.

In the determination step, the computer device 3 determines whether the trial parameter set for the sub-pixel conforms to both of the single-pixel criterion and the pixel-difference criterion.

In this embodiment, for a sub-pixel, the fitting deviation is defined as:

$$\mathrm{Dev}=(F-\mathrm{ABS})./R\times 100\%$$

where "Dev" represents the fitting deviation which is represented as a matrix composed of fitting deviation values that respectively correspond to the predetermined AOI luminance codes, "F" represents a fitting-data matrix composed of values of f(x) respectively corresponding to the predetermined AOI luminance codes, "ABS" represents a data-point matrix composed of the luminance values of the data points, "./" represents element-by-element right matrix division, and R represents a reference matrix composed of reference luminance values respectively corresponding to the predetermined AOI luminance codes. For instance, assuming that the data points corresponding to the sub-pixel have luminance values of L16, L32, L64, L128, L192 and L240 and respectively correspond to the predetermined AOI luminance codes of 16, 32, 64, 128, 192 and 240, and the reference luminance values are r16, r32, r64, r128, r192 and r240 and respectively correspond to the predetermined AOI luminance codes of 16, 32, 64, 128, 192 and 240, the fitting-data matrix (F), the data-point matrix (ABS) and the reference matrix (R) would respectively be:

F=[f(16) f(32) f(64) f(128) f(192) f(240)],

ABS=[L16 L32 L64 L128 L192 L240], and

R=[r16 r32 r64 r128 r192 r240], and the fitting deviation (Dev) for the sub-pixel would be:

$$Dev = [\,D16 \quad D32 \quad D64 \quad D128 \quad D192 \quad D240\,] = \left[\frac{f(16)-L16}{r16} \quad \frac{f(32)-L32}{r32} \quad \frac{f(64)-L64}{r64} \quad \frac{f(128)-L128}{r128} \quad \frac{f(192)-L192}{r192} \quad \frac{f(240)-L240}{r240}\right] \times 100\%$$

In one embodiment, each of the reference luminance values may be the average of the luminance values of the data points that correspond to the predetermined AOI luminance codes to which the reference luminance value corresponds. In one embodiment, the reference luminance values may correspond to a curve representing a relationship between luminance codes and luminance desired by the designer, such as the curve (C1) in FIG. 3.

In this embodiment, the single-pixel criterion is defined by setting, for each of the predetermined AOI luminance codes, a deviation range for the corresponding one of the fitting deviation values of the fitting deviation (Dev), and requires that each of the fitting deviation values falls within the corresponding deviation range. The deviation ranges that respectively correspond to the predetermined AOI luminance codes may be represented as a single-pixel deviation matrix (Sp). Following the example above, the single-pixel deviation matrix (Sp) may be exemplarily represented as:

Sp=[12% 8% 8% 5% 4% 4%], which means that the single-pixel criterion requires that |D16|<12%, |D32|<8%, |D64|<8%, |D128|<5%, |D192|<4% and |D240|<4%.

In this embodiment, the pixel-difference criterion is defined by setting, for each of the predetermined AOI luminance codes, a deviation difference range for a deviation difference between the single-pixel deviation values respectively corresponding to the sub-pixel and one of adjacent sub-pixels for the sub-pixel, and requires that the deviation difference falls within the corresponding deviation difference range. It is noted that the adjacent sub-pixels for a particular sub-pixel refer to some of the sub-pixels of the display panel 10 that are adjacent to the particular sub-pixel and that correspond to the same color element as the particular sub-pixel. The adjacent sub-pixels for the particular sub-pixel may be defined as required by the designer. For example, the adjacent sub-pixels for a particular sub-pixel may refer to the sub-pixels respectively at the right, left, upper and lower sides of the particular sub-pixel (totally four adjacent sub-pixels for the particular sub-pixel) in one embodiment, and refer to the sub-pixels respectively at the right, left, upper, lower, upper-right, upper left, lower-right and lower-left sides of the particular sub-pixel (totally eight adjacent sub-pixels for the particular sub-pixel) in another embodiment. The deviation difference ranges that respectively correspond to the predetermined AOI luminance codes may be represented as a deviation difference matrix (Dd). Following the example above, the deviation difference matrix (Dd) may be exemplarily represented as:

DD=[18% 12% 12% 8% 6% 6%], which means that the pixel-difference criterion requires that |D16−D16adj|<18%, |D32−D32adj|<12%, |D64−D64adj|<12%, |D128−D128adj|<8%, |D192−D192adj|<6% and |D240−D240adj|<6%, where D16adj, D32adj, D64adj, D128adj, D192adj, D240adj respectively represent the fitting deviation values corresponding to an arbitrary one of the adjacent sub-pixels for the sub-pixel.

When the computer device 3 determines that the trial parameter set for the sub-pixel conforms to both of the single-pixel criterion and the pixel-difference criterion, the flow goes to step 214 (see FIG. 2), in which the trial parameter set is used as the fixed-point parameter set.

When the computer device 3 determines that the first fixed-point parameter set for the sub-pixel does not conform to either one of the single-pixel criterion and the pixel-difference criterion, the quantization step is repeated for the next cycle, in which another quantization algorithm or a higher fixed-point resolution is used for floating-point quantization.

In one embodiment, the quantization step is performed using the rounding function in the first cycle. In the subsequent cycle(s) (if needed), different quantization algorithm combinations may be used to obtain another trial parameter set under the same fixed-point resolution (e.g. 8 bits). When it is concluded that only changing the quantization algorithm combinations cannot make the resultant trial parameter set conform with both the single-pixel criterion and the pixel-difference criterion, a higher fixed-point resolution (e.g., 10 bits) may be used in the later cycles. Accordingly, by such iterative operation, a proper trial parameter set that conforms to both of the single-pixel criterion and the pixel-difference criterion may be found to serve as the fixed-point parameter set for demura operation. Through the abovementioned floating-point quantization, a large number of the function parameter sets, which are in a form of floating points and which respectively correspond to all of the sub-pixels of the display panel 10, may be transformed into a small number of the fixed-point parameter sets. The fixed-point parameter sets may be stored in a non-volatile memory (e.g., a flash memory, EEPROM, etc.) of the display panel 10 for subsequent use by the processor 20 of the computerized device 10.

In step 214, a plurality of demura lookup tables are generated based on the desired relationship between luminance codes and luminance and based on the fixed-point parameter sets corresponding to the target sub-pixels to achieve fast and simple demura operation. Each demura lookup table is used to output a modified luminance codes in response to a luminance codes input thereto. However, it is not necessary to use a demura lookup table for demura operation of every single sub-pixel. Some embodiments may use the demura lookup tables for demura operation of only a portion of the sub-pixels, and use other demura method(s), such as logic circuits, for demura operation of the other sub-pixels. Accordingly, the portion of the sub-pixels of which the demura operation uses the demura lookup tables are denoted as target sub-pixels hereinafter. In one implementation, it is the computer device 3 that calculates the demura lookup tables based on the desired relationship between luminance codes and luminance and the fixed-point parameter sets, and the demura lookup tables are stored in the non-volatile memory unit 50 on the main board of the computerized device 1 in the production line. In another implementation, the fixed-point parameter sets and the desired relationship between luminance codes and luminance and may be stored in a non-volatile memory (e.g., a flash memory module, an EEPROM, etc.) on the display panel 10, and, when the computerized device 1 is turned on for the first time, the processor 20 may read the fixed-point parameter sets and the desired relationship between luminance codes and luminance from the display panel 10, calculate the demura lookup tables, and store the demura lookup tables thus calculated in the non-volatile memory unit 50. In this embodiment, all of the sub-pixels of the display panel 10 are the target sub-pixels. After the demura lookup tables are established, the computerized device 1 may perform demura operation for the target sub-pixels by adjusting the luminance codes corresponding to the target sub-pixels according to the demura lookup tables In the case depicted in FIG. 3, for example, when control for displaying a to-be displayed image includes a luminance codes of 175 for the sub-pixel, the sub-pixel is expected to have luminance of L1 according to the curve (C1). However, the sub-pixel may only have luminance of L2 in correspondence to the luminance codes of 175 according to the target fitting curve (C2). In order to achieve the desire luminance of (L1), the demura lookup table for the sub-pixel may be established to have an output of a luminance codes of 200 in response to an input of a luminance codes of 175. In other words, the demura lookup table is established to reduce the difference between the curve (C1) and the curve (C2) for the sub-pixel at each of the luminance codes.

Figure 5:
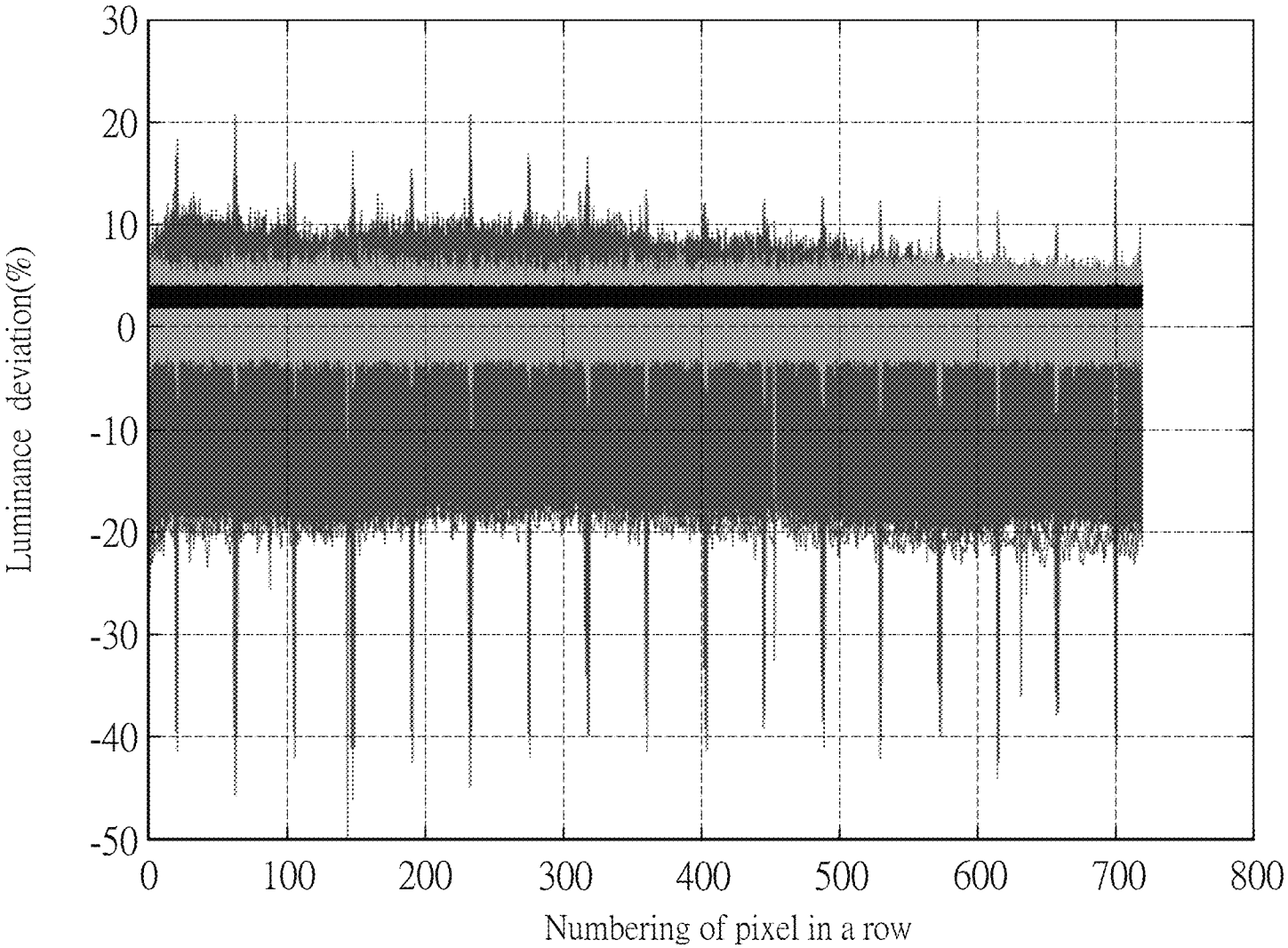
FIG. 5 is a plot showing a result of demura operation according to this disclosure.

FIG. 5 is a plot showing experimental data for a display panel which has a resolution of 720×1280 (720 columns and 1280 rows of pixels) at a luminance codes of 192. It is noted that the dark gray part is composed of 1280 dark gray curves each indicating a luminance deviation of the sub-pixels along a respective row consisting of 720 pixels relative to the desired relationship between luminance codes and luminance when no demura operation is performed; that the light gray part is composed of 1280 light gray curves each indicating a luminance deviation of the sub-pixels along a respective row consisting of 720 pixels relative to the desired relationship between luminance codes and luminance when a conventional demura operation that uses piecewise linear approximation and conventional floating-point quantization for curve fitting is performed; and that the black part is composed of 1280 black curves each indicating a luminance deviation of the sub-pixels along a respective row consisting of 720 pixels relative to the desired relationship between luminance codes and luminance when the proposed two-stage curve fitting and the proposed iterative floating-point quantization are used for demura operation. Evidently, the demura operation based on the proposed two-stage curve fitting and the proposed floating-point quantization process that employs the single-pixel criterion and the pixel-difference criterion according to this disclosure causes the display panel to have better luminance uniformity.

After the demura lookup tables are stored in the non-volatile memory element (e.g., the non-volatile memory unit 50 on the main board in this embodiment) of the computerized device 1 in which the display panel 10 is assembled, the computerized device 1 can load the demura tables into the volatile memory element (e.g., the first volatile memory unit 30 and/or the second volatile memory unit 40 on the main board in this embodiment, or a volatile memory unit on the display panel 10 or other parts of the computerized device 1 in other embodiments) during operation, and thus display images with good luminance uniformity based on the demura lookup tables loaded into the volatile memory element. In some cases where a total number of the demura lookup tables is very small, the demura lookup tables may all be stored in the limited storage capacity of the SRAM, which is for the source driver ICs of the display panel 10, for use by the display panel 10 to perform demura operation. In some cases, the SRAM for the source driver ICs of the display panel 10 may be used to store only the demura lookup tables that correspond to the most representative fixed-point parameter sets (e.g., corresponding to more than 90% of the sub-pixels)), and demura operations for the other sub-pixels may be performed through computation by logic circuits. In this embodiment, it is assumed that the SRAM for the source driver ICs of the display panel 10 is unable to store all the demura lookup tables, so the demura operation for all sub-pixels may be performed by the components mounted on the main board of the computerized device 1, and not by the display panel 10.

Figure 6:
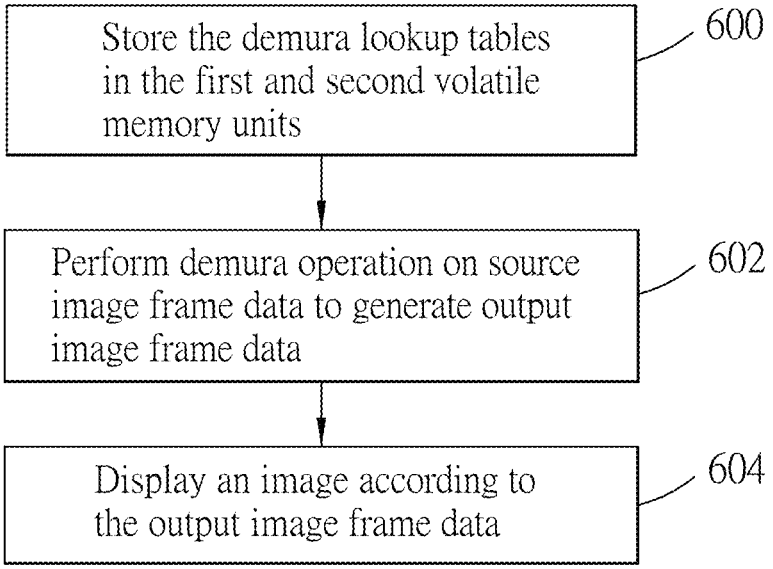
FIG. 6 is a flow chart illustrating how a processor implements the demura operation in the embodiment according to this disclosure.

In this embodiment, the non-volatile memory unit 50 has pre-stored therein the demura lookup tables that are established based on luminance uniformity of the display panel 10. Each sub-pixel of the display panel 10 corresponds to one of the demura lookup tables, which is predefined based on an intrinsic relationship between luminance codes and luminance of the sub-pixel, and a desired relationship between luminance codes and luminance for all sub-pixels. FIG. 6 illustrates how the processor 20 implements the demura operation in this embodiment. When the computerized device 1 is turned on, the processor 20 loads the demura lookup tables from the non-volatile memory unit 50 (note that the demura lookup tables may be calculated and stored in the non-volatile memory unit 50 either on the production line or during initialization process of the computerized device 1 when the computerized device 1 is turned on for the first time), and stores the demura lookup tables in the first and second volatile memory units 30, 40 for higher access speed (step 600). In this embodiment, the computerized device 1 is a smartphone, and the processor 20 is the application processor of the smartphone, so the processor 20 may load a portion of the demura lookup tables into the SRAM mounted on the main board of the smartphone, which serves as the first volatile memory unit 30, and load the remaining portion of the demura lookup tables into the DRAM mounted on the main board of the smartphone, which serves as the second volatile memory unit 40.

In this embodiment, the first volatile memory unit 30 is an SRAM unit and the second volatile memory unit 40 is a DRAM unit. Although the SRAM has a higher access speed in comparison to the DRAM, the SRAM is much more expensive than the DRAM, so the SRAM usually has much smaller storage capacity than the DRAM in an electronic device. In consideration of cost, a number of the demura lookup tables that can be stored in the SRAM is predetermined, and all other demura lookup tables must be stored in another memory unit of which the access speed is relatively low, such as the DRAM. To efficiently make use of the SRAM, the demura lookup tables are divided into a first group to be stored in the SRAM, and a second group to be stored in the DRAM, where the first group consists of a predetermined table number (e.g., 256, 128, 64, etc., depending on the storage capacity of the SRAM) of demura lookup tables that correspond to a high percentage, e.g., more than ninety percent, of the sub-pixels of the display panel 10, and the second group consists of the demura lookup tables other than those of the first group. Note that the method of this disclosure is still workable even if the SRAM only stores the demura lookup tables that correspond to less than ninety percent of the sub-pixels of the display panel, but the bandwidth of the DRAM may be occupied by the display operation at a relatively higher ratio, which may adversely affect other operations that may also require to make use of the DRAM. In one example, the demura lookup tables for ninety percent or more of the sub-pixels are stored in the SRAM that has the higher access speed and only a relatively small number of the sub-pixels correspond to the demura lookup tables stored in the DRAM that has the lower access speed, so the demura operation for an entire frame to be displayed on the display panel 10 may be completed within a predefined time limit. It is noted that this embodiment uses the processor 20 of the computerized device 1 (e.g., the application processor of the smartphone) to perform demura operation, so the SRAM which is employed by the processor 20 and which usually has a relatively large storage capacity in comparison to the SRAM used by source driver ICs of the display panel 10 may have sufficient capacity to store the required number (the predetermined table number) of the demura lookup tables. In detail, a number of the fixed-point parameter sets are selected from all of the sets of fixed-point parameters, where the number equals the predetermined table number. Then, the first group of the demura lookup tables is generated based on the selected ones of the fixed-point parameter sets (amounting to the predetermined table number) and the desired relationship between luminance codes and luminance, and the second group of the demura lookup tables is generated based on the fixed-point parameter sets other than the selected ones and the desired relationship between luminance codes and luminance.

In one exemplary implementation where a display panel has 1800×900=1,620,000 sub-pixels for each color element, 1,620,000 corresponding function parameter sets may be converted into 519 fixed-point parameter sets by using the proposed two-stage curve fitting and the iterative floating-point quantization process according to this disclosure, where the most representative 64 (out of 519) fixed-point parameter sets correspond to 91.61% of the 1,620,000 sub-pixels, while the other 455 (out of 519) fixed-point parameter sets correspond to 8.39% of the 1,620,000 sub-pixels. Accordingly, the manufacturer may decide to employ the SRAM whose capacity allows storage of only 64 demura lookup tables for storing the first group of the demura lookup tables (corresponding to 91.61% of the sub-pixels), and to employ the DRAM for storing the second group of the demura lookup tables (the other 455 demura lookup tables) when the computerized device 1 is in use, thereby using the SRAM (first volatile memory unit 30), which is usually faster and more expensive than the DRAM (second volatile memory unit 40), in an efficient way, and achieving the required data transferring speed without inducing a large increase in cost. On the other hand, with poor polynomial approximation (curve fitting) and a poor quantization rule, the 1,620,000 function parameter sets may be converted into, for example, 2199 floating-point parameter sets, where the most representative 64 (out of 2199) floating-point parameter sets correspond to only 49.15% of the 1,620,000 sub-pixels, and the most representative 256 (out of 2199) floating-point parameter sets correspond to 87.73% of the 1,620,000 sub-pixels. Accordingly, the manufacturer may employ the SRAM with greater capacity to store the 256 demura lookup tables that correspond to 87.73% of the sub-pixels when the computerized device 1 is in use, thereby increasing the cost while the overall performance is still inferior than that of the former example (where 91.61% of the sub-pixels correspond to 64 demura lookup tables stored in the SRAM).

In step 602, the processor 20 performs demura operation on pre-demura image frame data to generate post-demura image frame data serving as output image frame data and including a plurality of luminance codes which respectively correspond to the luminance codes of the pre-demura image frame data. The pre-demura image frame data may originate from an image source (e.g., the Internet, storage devices, multimedia service providers, media players, other image processing blocks, etc.). In this embodiment, the processor 20 performs the demura operation by acquiring, for each of the luminance codes of the pre-demura image frame data, the corresponding one of the luminance codes of the post-demura image frame data according to a corresponding one of the demura lookup tables (i.e., a demura lookup table corresponding to a sub-pixel to which the luminance code of the pre-demura image frame data corresponds). The correspondences between the sub-pixels and the demura lookup tables may be pre-stored in the non-volatile memory unit 50 and/or a non-volatile memory on the display panel 10 in a form of a lookup table (correspondence lookup table), and may be loaded to the DRAM when the computerized device 1 is turned on. However, it is noted that the demura operation is not limited to that used in this embodiment. In other embodiments, the demura operation may be performed through calculation using logic circuits, which may be disposed on either the main board or the display panel 10.

In one example, the processor 20 reads out the luminance codes of the pre-demura image frame data one by one from the DRAM to acquire, based on the correspondence lookup table, a memory address for acquiring a corresponding luminance code for the output image frame data. In practice, a first luminance code read out by the processor 20 from a specific memory address may be the luminance code of the pre-demura image frame data for the first sub-pixel, so the processor 20 acquires information indicating which one of the demura lookup tables corresponds to the first sub-pixel and where the corresponding demura lookup table is stored (in the SRAM or the DRAM) according to the correspondence lookup table, and then acquires the corresponding luminance code for the first sub-pixel to be part of the post-demura image frame data (output image frame data in this embodiment) (i.e., one of the luminance codes of the post-demura image frame data that corresponds to the first sub-pixel) according to the demura lookup table that corresponds to the first sub-pixel; a second luminance code read out by the processor 20 from a memory address next to the specific memory address of a first DRAM block of the DRAM may be the luminance code of the pre-demura image frame data that corresponds to the second sub-pixel, so the processor 20 acquires information indicating which one of the demura lookup tables corresponds to the second sub-pixel and where the corresponding demura lookup table is stored (in the SRAM or the DRAM) according to the correspondence lookup table, and then acquires the corresponding luminance code for the post-demura image frame data for the second sub-pixel according to the demura lookup table that corresponds to the second sub-pixel; so on and so forth.

Based on the luminance code of the pre-demura image frame data for a pixel and the correspondence read out from the DRAM, the processor 20 can acquire a memory address of the corresponding luminance code for the post-demura image frame data for the same pixel, read out a corresponding luminance code for the post-demura image frame data from the corresponding SRAM or DRAM according to the acquired memory address, and store the luminance code for the post-demura image frame data for that pixel in the DRAM. The processor 20 may provide the post-demura image frame data to the source driver ICs after all of the luminance codes for the post-demura image frame data have been acquired and stored in the DRAM, but this disclosure is not limited in this respect.

In step 604, the processor 20 provides the output image frame data (the post-demura image frame data in this embodiment) to the source driver ICs to perform digital-to-analog conversion and to drive the display panel 10 to display the image of the frame based on the output image frame data. In one embodiment, the output image frame data may be transmitted in a form of analog voltages. Details of this step should be well known in the art and will be omitted herein for the sake of brevity. By using the SRAM on the main board to store the first group of the demura lookup tables and using the DRAM on the main board to store the second group of the demura lookup tables, speed of demura operation using these demura lookup tables should be fast enough to fulfill requirements for the majority of general applications. However, in some applications that require very fast demura speed and very good performance, such as applications for virtual reality or augmented reality, the demura operation may be performed using the demura lookup tables stored in the SRAM and DRAM on the main board of the computerized device 1, in cooperation with logic circuits that are designed for demura operation.

In summary, this disclosure proposes to enhance luminance uniformity of a display panel in two aspects that are independent with respect to each other. One aspect is the two-stage curve fitting for obtaining a good data-points fitting curve that fits the data points measured by the AOI system 2 well. The two-stage curve fitting may (but not necessarily) cooperate with the proposed iterative floating-point quantization process to convert, based on the single-pixel criterion and the pixel-difference criterion, the large number of the function parameter sets into the small number of the fixed-point parameter sets for the sub-pixels, thereby reducing hardware requirement for demura operation while maintaining good demura effect. In addition, by establishing the demura lookup tables and dividing them into two groups, one of which includes a predetermined number of the most representative demura lookup tables (preferably corresponding to more than 90% of sub-pixels) and is to be stored in the SRAM, and the other one of which is to be stored in the DRAM, the high-speed yet expensive SRAM may be efficiently utilized, thereby achieving good cost control while providing satisfactory performance.

In the description above, for the purposes of explanation, numerous specific details have been set forth in order to provide a thorough understanding of the embodiment(s). It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects.

While the disclosure has been described in connection with what is (are) considered the exemplary embodiment(s), it is understood that this disclosure is not limited to the disclosed embodiment(s) but is intended to cover various arrangements included within the spirit and scope of the broadest interpretation so as to encompass all such modifications and equivalent arrangements.

What is claimed is:

1. A method for enhancing luminance uniformity of a display panel that includes a plurality of sub-pixels for a same color element, said method comprising:

measuring, by an automated optical inspection (AOI) system and for each of the sub-pixels, luminance of the sub-pixel each time a different one of multiple predetermined AOI luminance codes is used to drive the sub-pixel, so as to obtain a plurality of data points for the sub-pixel, where each of the data points is composed of one of the predetermined AOI luminance codes and a luminance value of the sub-pixel that is measured by the AOI system when said one of the predetermined AOI luminance codes is used to drive the sub-pixel;

generating, by the computer device, a first polynomial function describing a first reference curve that represents a first reference relationship between luminance code and luminance and that has a plurality of first reference data points each of which is composed of one of the predetermined AOI luminance codes and a first reference luminance value corresponding to said one of the predetermined AOI luminance codes;

generating, by the computer device and for each of the sub-pixels, a plurality of second reference data points each of which is composed of one of the predetermined AOI luminance codes, and a second reference luminance value relating to a difference between the first reference luminance value corresponding to said one of the predetermined AOI luminance codes and the luminance value of one of the data points corresponding to the sub-pixel and said one of the predetermined AOI luminance codes;

performing, by the computer device and for each of the sub-pixels, curve fitting on the second reference data points corresponding to the sub-pixel to obtain a second polynomial function that describes a curve fitting the second reference data points which correspond to the sub-pixel;

acquiring, by the computer device and for each of the sub-pixels, a data-points fitting function based on the first polynomial function and the second polynomial function;

performing, by a computerized device that includes the display panel, demura operation on pre-demura image frame data based on the data-points fitting functions corresponding to the sub-pixels to generate post-demura image frame data, wherein the pre-demura image frame data relates to an image of a frame to be displayed by the display panel; and displaying, by the display panel, the image of the frame based on the post-demura image frame data.

2. The method of claim 1, wherein the first polynomial function has a degree of N, and the second polynomial function has a degree of M, where $M \leq N$.

3. The method of claim 2, wherein the data-points fitting function is obtained by adding the first polynomial function and the second polynomial function together.

4. The method of claim 1, wherein, for each of the first reference data points, the first reference luminance value relates to the luminance values of the data points that correspond to the predetermined AOI luminance code of the first reference data point, and the generating the first polynomial function includes:

generating, by the computer device, the first reference data points; and performing, by the computer device, curve fitting on the first reference data points to obtain the first polynomial function that describes a curve fitting the first reference data points.

5. The method of claim 4, wherein the first reference luminance value of each of the first reference data points is generated by:

averaging the luminance values of the data points that correspond to the predetermined AOI luminance code of the first reference data point; and wherein the second reference luminance value of each of the second reference data points for each of the sub-pixels is generated by:

subtracting the first reference luminance value that corresponds to the predetermined AOI luminance code of the second reference data point from the luminance value of one of the data points that corresponds to the sub-pixel and the predetermined AOI luminance code of the second reference data point.

6. The method of claim 1, further comprising, before the performing the demura operation:

extracting, by the computer device and for each of the sub-pixels, a function parameter set from the data-points fitting function corresponding to the sub-pixel; and performing, by the computer device and for each of the sub-pixels, floating-point quantization on the function parameter set that corresponds to the sub-pixel to obtain a fixed-point parameter set that is used to describe a target fitting curve conforming to a single-pixel criterion and a pixel-difference criterion, wherein the single-pixel criterion relates to a fitting deviation that corresponds to the sub-pixel and that relates to a mismatch between the target fitting curve and the data points corresponding to the sub-pixel, and the pixel-difference criterion relates to differences between the fitting deviation corresponding to the sub-pixel and the fitting deviations corresponding to some of the sub-pixels that are adjacent to the sub-pixel;

wherein the performing the demura operation on the pre-demura image frame data is based on the fixed-point parameter set.

7. The method of claim 6, the pre-demura image frame data including a plurality of luminance codes that respectively correspond to the sub-pixels, the sub-pixels of the display panel for the color element including a plurality of target sub-pixels, said method further comprising, before performing the demura operation:

generating, by one of the computer device and the computerized device, a plurality of demura lookup tables based on a desired relationship between luminance code and luminance and the fixed-point parameter sets corresponding to the target sub-pixels;

wherein the performing the demura operation on the pre-demura image frame data includes:

adjusting, for the target sub-pixels, the corresponding ones of the luminance codes according to the demura lookup tables to acquire the post-demura image frame data.

8. The method of claim 7, wherein the demura lookup tables are divided into a first group and a second group, the first group consisting of a predetermined table number of the demura lookup tables, the second group consisting of the demura lookup tables other than those of the first group;

said method further comprising, before the performing the demura operation:

storing, by a processor that is mounted on a main board of the computerized device, the first group of the demura lookup tables in a first volatile memory unit for use in the demura operation, the first volatile memory unit being mounted on the main board of the computerized device and being electrically connected to the processor; and storing, by the processor of the computerized device, the second group of the demura lookup tables in a second volatile memory unit for use in the demura operation, the second volatile memory unit being mounted on the main board of the computerized device and being electrically connected to the processor;

wherein the demura operation is performed by the processor based on the demura lookup tables stored in the first volatile memory unit and the second volatile memory unit;

wherein an access speed of the first volatile memory unit is higher than an access speed of the second volatile memory unit; and wherein the predetermined table number relates to storage capacity of the first volatile memory unit.

9. The method of claim 8, wherein the first volatile memory unit is a static random access memory (SRAM) unit, and the second volatile memory unit is a dynamic random access memory (DRAM) unit.

* * * * *